United States Patent [19]

Otaki et al.

[11] 4,263,368

[45] Apr. 21, 1981

[54] PROCESS FOR PRODUCING A POTENTIALLY BULKY YARN

[75] Inventors: Yukio Otaki; Masatoshi Mineo; Kiyoshi Nakagawa, all of Mishima; Shiro Nishiumi; Yoshio Aratani, both of Otsu, all of Japan

[73] Assignee: Toray Industries, Inc., Tokyo, Japan

[21] Appl. No.: 1,397

[22] Filed: Jan. 5, 1979

Related U.S. Application Data

[63] Continuation of Ser. No. 813,177, Jul. 15, 1977, abandoned, which is a continuation of Ser. No. 592,519, Jul. 2, 1975, abandoned.

[51] Int. Cl.[3] ..... D02G 3/00

[52] U.S. Cl. ..... 428/373; 28/259; 428/364; 428/369; 428/399

[58] Field of Search ..... 428/373, 374, 364, 399, 428/369; 57/243, 246; 28/259, 260, 261

[56] References Cited

U.S. PATENT DOCUMENTS

| | | | |
|---|---|---|---|
| 2,974,391 | 3/1961 | Speakman et al. . | |
| 3,047,932 | 8/1962 | Pittman et al. . | |
| 3,095,630 | 7/1963 | Pittman . | |
| 3,112,551 | 12/1963 | Schmieder et al. . | |
| 3,224,068 | 12/1965 | Edington . | |
| 3,444,682 | 5/1969 | Polacco et al. | 428/399 X |
| 3,498,044 | 3/1970 | Hopkins . | |
| 3,538,566 | 11/1970 | Mitsuishi et al. . | |
| 3,591,954 | 7/1971 | Horvath | 28/259 X |
| 3,601,872 | 8/1971 | Potman et al. | 28/259 X |
| 3,651,193 | 3/1972 | Barlow et al. . | |

FOREIGN PATENT DOCUMENTS

| | | | |
|---|---|---|---|
| 805868 | 2/1969 | Canada | 28/261 |
| 39-26147 | 11/1964 | Japan | 28/260 |
| 45-4737 | 11/1970 | Japan | 28/259 |
| 1154285 | 6/1969 | United Kingdom | 28/259 |

*Primary Examiner*—Lorraine T. Kendell
*Attorney, Agent, or Firm*—Miller & Prestia

[57] ABSTRACT

A process for producing a potentially bulky yarn which is a substantially non-interlaced multifilament yarn of a thermoplastic synthetic fiber satisfying the characteristic values of $R_{max}/R \leqq 2.5$, $\Delta S_5 \geqq 1.5$, $\Delta S_{50} \leqq 3.0$, $Y \geqq 1.3$ and $X_T - X \leqq 1.0$, where $R_{max}$ is maximum tension fluctuation width, R is average tension fluctuation width of a normal portion, $\Delta S_5$ is difference in maximum shrinkage among each filament of a sample having a length of 5 cm, $\Delta S_{50}$ is difference in maximum shrinkage among each filament of a sample having a length of 50 cm, $X_T$ is maximum tension, X is average tension and Y is degree of bulkiness/dry heat shrinkage.

A bulky, processed yarn is obtained by supplying a substantially non-twisted thermoplastic multifilament yarn to a heated body under a tension of 10–120 mg/d with monofilament contact said heated body at an imaginary point of contact and monofilaments not contacting said heated body at said imaginary point of contact, at the same time contacting said yarn with said heated body within such a short period of time that the heat of said heated body may not uniformly be conducted to the multifilament yarn, and either immediately thereafter winding the yarn, or in the alternative not winding said yarn immediately thereafter, but contacting said yarn with another heated body under conditions not substantially elongating the yarn, thereby eliminating produced loops, and thereafter winding said yarn.

13 Claims, 13 Drawing Figures

PROCESS FOR PRODUCING A POTENTIALLY BULKY YARN

This is a continuation of application Ser. No. 813,177, filed July 15, 1977, now abandoned, which, in turn, was a continuation of application Ser. No. 592,519, filed July 2, 1975, abandoned.

GENERAL FIELD OF THE INVENTION

The present invention relates to a multifilament yarn of a thermoplastic synthetic fiber having excellent uniformity, having concurrently low contractibility and bulkiness sufficient for a knitted or woven fabric.

DISCUSSION OF THE PRIOR ART

In general, there are known; a process for processing a multifilament yarn of a synthetic fiber for a knitted or woven fabric into a bulky yarn, a process for processing such multifilament yarn into a crimped yarn by false-twisting, a process for processing such multifilament yarn into a crimped yarn by abrasion or disturbance of a fluid, a process for processing such multifilament yarn into a conjugated yarn by difference in structure of fibers, and a process for mixing 2-component filament yarn which differ in shrinkage.

A process has also been proposed for imparting bulkiness to a yarn by irregularly heat-treating monofilaments constituting a multifilament yarn, for example, heat-treating a thermoplastic multi-filament yarn with at least one heated body by contact therewith under tension, allowing the yarn to contract so as to cause a difference in contraction among the monofilaments, and winding the yarn under a tension sufficient for eliminating loops and convolutions produced, or while leaving said loops and convolutions as they are.

However, conventional bulky processed yarns are generally too high in contraction for a knitted or woven fabric, especially for a woven fabric, requiring substantial dragging in a finishing stage, and it has been difficult to obtain a woven fabric which is excellent in feel and softness. A bulky yarn obtained by said irregular heat-treatment forms a complicated crimp. However, non-uniformity at the time of heat-treatment is very evident and a woven fabric using this yarn has the drawback that is only accepts short, strong streaky and uneven dyeing.

We have already proposed, for preventing the increase of such non-uniformity, a process for producing a bulky or processed yarn which comprises drawing an undrawn yarn, interlacing the resultant drawn yarn and thereafter running the yarn in contact with a heated body for such a period that the heat of said heated body may not be uniformly conducted to said yarn. However, according to this process, there is a problem in that when the degree of interlaced monofilaments is increased, the uniformity is improved, but the bulkiness lowers. In contrast, when the degree of interlaced monofilaments is decreased, portions of interlaced monofilaments having small bulkiness and another portions of interlaced monofilaments having substantial bulkiness are formed similar to slub yarn. In such a case it is difficult to obtain a bulky yarn having uniformity, since the differences in bulk quality along the yarn length are large.

OBJECTS OF THE INVENTION

Objects of the present invention are to eliminate the drawbacks of the prior art with reference to processing of a yarn into a bulky yarn and to provide a process for producing bulky processed yarn of a synthetic fiber combining large bulkiness and small shrinkage with excellent uniformity as a whole.

DESCRIPTION OF THE PREFERRED EMBODIMENTS

The aforementioned object of the present invention may be achieved by providing a potentially bulky processed yarn which is a potentially substantially non-interlaced thermoplastic multifilament yarn such as one of the polyester series and the like satisfying simultaneously the following conditions (A)-(D); when $R_{max}$ is maximum tension fluctuation width, $\overline{R}$ is average tension fluctuation width of a normal portion, $\Delta S_5$, $\Delta S_{50}$ are maximum difference in shrinkage among each filament of samples having lengths of 5 cm and 50 cm, respectively, Y is degree of bulkiness/dry heat shrinkage, and $X_T$, $\overline{X}$ are maximum and average tensions:

(A) $R_{max}/\overline{R} \leqq 2.5$ (B) $\Delta S_5 \geqq 1.5$ and $\Delta S_{50} \leqq 3.0$ (C) $Y \geqq 1.3$ (D) $X_T - \overline{X} \leqq 1.0$ Methods of measuring characteristic values cited in (A)-(D) above will be explained hereinbelow.

Method of Measuring Tension Fluctuation Width

Figure 1:
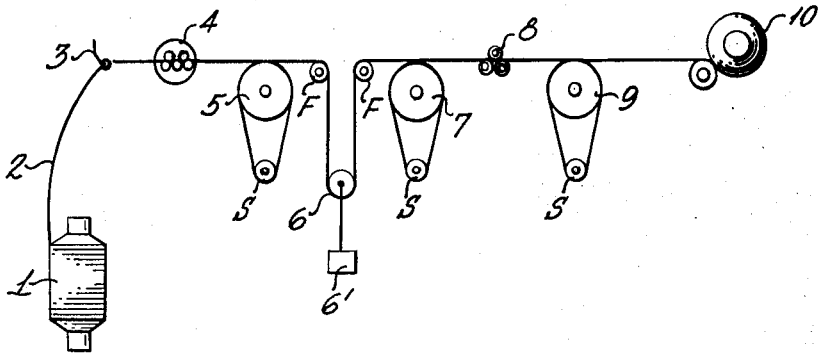
FIG. 1 is a potentially fragmentary side elevation of an apparatus for measuring fluctuation values of tension of a potentially bulky processed yarn.

FIG. 1 is a diagrammatic view of an apparatus for measuring $R_{max}$ and $X_T - \overline{X}$, in which a yarn 2 to be measured is removed from a package 1 and adjusted for primary tension by a tension compensating device 4 via a guide 3. The tension of said yarn 2 is adjusted to constant tension under a load of 0.3 g/d by a dancer roller 6 and a load 6' between rollers 5 and 7 rotating at the same speeds. Thereafter, the yarn is caused to run continuously at a surface speed for roller 9 of 30 m/min while being stretched by 7.5% between the roller 7 and roller 9 disposed at an interval of 150 mm. The fluctuation of tension at a stretched portion at this time is measured by a pickup 8 and recorded at a chart speed of 60 mm/min. In FIG. 1, F shows a frictionless roller, S a separate roller and 10 a winder.

Figure 2:
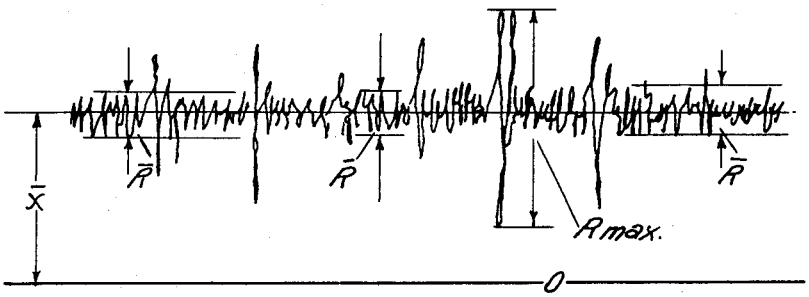
FIGS. 2 and 3 are charts showing fluctuation states of tensile strength of a potentially bulky processed yarn measuring by an apparatus as FIG. 1.

FIG. 2 shows one example of a measurement chart obtained by use of the apparatus of FIG. 1. In an optional portion of the chart having a length of 15 cm. a maximum fluctuation width $R_{max}$ (g) and an average fluctuation width $\overline{R}$ (g) of a normal portion at three 2 cm-long portions at regular intervals of 3 cm of the length of the chart may be read.

Method of Measuring Shrinkage

A sample multifilament yarn is cut into lengths of 5 cm and 50 cm, the cut portions are subjected to a dry heat-treatment at 200° C. for 5 minutes under conditions allowing for free contraction, and from the difference of shrinkages between a component monofilament exhibiting maximum contraction and a component monofilament exhibiting minimum contraction, $\Delta S_5$ (a sample having a length of 5 cm) and $\Delta S_{50}$ (a sample having a length of 50 cm) are sought. Namely, $\Delta S$=shrinkage of a maximum contraction monofilament minus shrinkage of a minimum contraction monofilament. (However, the shrinkage is a percentage of a reduced length due to the heat-treatment to the original length of the sample.)

Method of Measuring Dry Heat Shrinkage 80 m of a sample multifilament yarn is made into a skein having a peripheral length of 1 m, the initial length $l_1$ (cm) of which is read under a load of 0.1 g/d, said skein is hung in an atmosphere of 200±2° C. for 5 minutes under no load to carry out heat-treatment, and the skein length $l_2$ (cm) of the heat-treated skein is read again under a load of 0.1 g/d. The dry heat shrinkage (SH) is calculated by the following formula $$SH\ (\%) = (l_1 - l_2)/l_1 \times 100$$

Method of Measuring Degree of Bulkiness

Figure 4:
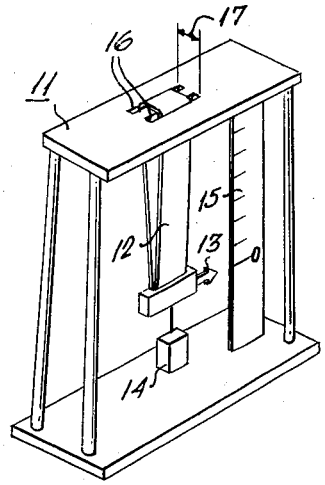
FIG. 4 is a perspective view of an apparatus for measuring degree of bulkiness.
Figure 5A:
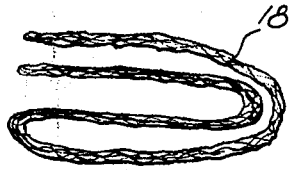
FIG. 5 shows sketches of a process for measuring the degree of bulkiness.
Figure 5B:
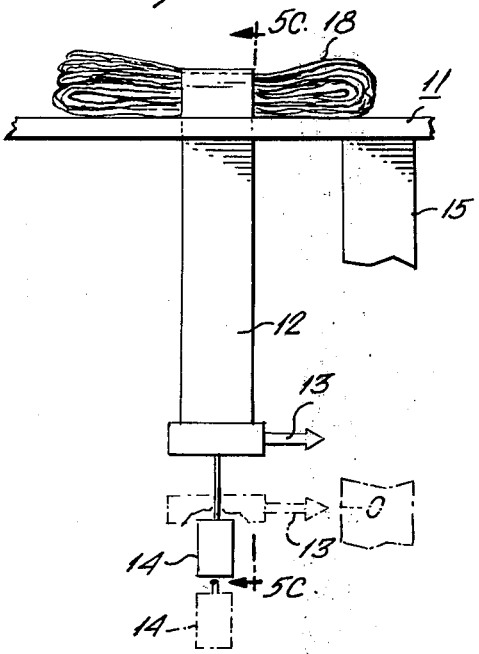
Figure 5C:
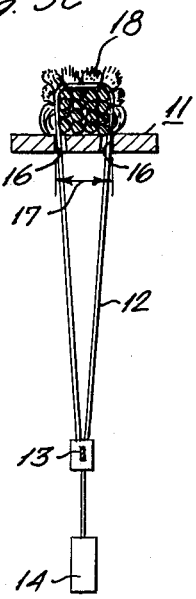

FIG. 4 is a perspective view of an apparatus for measuring degree of bulkiness (M), and FIG. 5 explains the measuring method by use of this apparatus.

On the upper surface of a sample stand 11, two slits 16 are provided, the interval 17 between the outside edges of said 2 slits is 6 mm, and the slits 16 are covered with a 2.5 cm wide soft thin fabric 12. At the foot of the fabric, a metal fitting equipped with an indicator 13 and a load 14 are connected. The indicator of the metal fitting 13 is so set as to indicate zero units on the graduation 15 when the sample is not inserted.

As samples, 2–10 skeins of reeling having a peripheral length of 1 m made from an 80 m long yarn are prepared in accordance with indicated deniers. Each one of these skeins is separately hung in an atmosphere of 200±2° C. under no load for 5 minutes to carry out the heat-treatment. The heat-treated skeins are arranged in parallel so that the indicated denier becomes 48,000 denier (for example, in the case of a 30 denier yarn, 30×80×2=4,800 , 48,000: 4,800=10, 10 skeins, and in the case of a 75 denier yarn, 75×80×2=12,000, 48,000: 12,000=4, 4 skeins). Next, the thus arranged skeins are folded in four as shown in FIG. 5 (A) to form a sample 18, which is inserted between the thin fabric tape 12 and the sample stand 11 as shown in the front elevation of FIG. 5 (B). The load 14 and the metal fittings equipped with an indicator are adjusted to weigh 50 g altogether, and the value L (cm) shown by the indicator is read. The sample 18 to be measured is transferred into position and measured a total of three times, and the average value $\overline{L}$ (cm) is calculated.

The degree of bulkiness M is calculated from the following equation:

$$M\ (\text{cc/g}) = \frac{\text{Volume in tape}}{\text{Weight of yarn in tape}} = \frac{V}{W}$$

$$V = \frac{L^{-2}}{\Pi} \times 2.5$$

$$W = D \times \frac{100}{100 - SH} \times P \times \frac{1}{9000} \times 0.025$$

wherein D is the denier of the sample yarn before heat-treatment and P is number of yarns entering the tape in parallel. The value of Y is sought from Y=M/SH.

As a result of measuring by the foregoing method, in FIG. 2, the more uniform the wavy shape in the transverse direction (lengthwise direction of the yarn), the more excellent the uniformity of the yarn.

Namely, $R_{max}/\overline{R}$ is a measure of the uniformity of the yarn and a smaller numerical value is preferable. In the case of a multifilament yarn whose value of $R_{max}/\overline{R}$ is above 2.5, when woven into a fabric, strong streaks and uneven dyeing increase.

Figure 3:
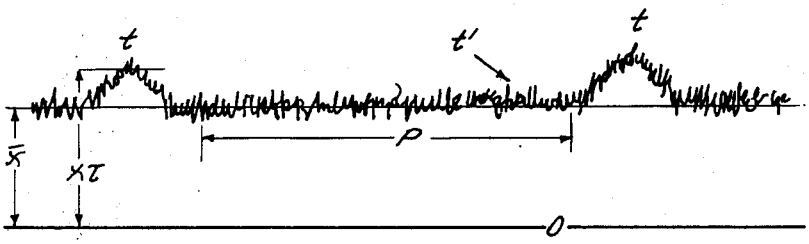

FIG. 3 is an example illustrating the measuring of a yarn obtained by running a drawn yarn of a so-called pirn winding having a tapered part in contact with a heated body. In FIG. 3, there are shown periodic disorders of the wavy shape shown by t. It is inferred that said t is a yarn part wound around an original taper part of a pirn and P is a yarn part wound around a straight part of the pirn. t' is a taper part of the pirn after heat-treatment. When the original package of drawn yarn has the shape of a non-tapered part of the pirn, for example, a drum-wound yarn, the size of the wavy shape periodic disorders appearing in the chart is small. $X_T$ is the maximum tension (g) of wavy shape periodic disorders appearing on the chart regardless of the length of the chart. $\overline{X}$ shows average tension (g) of a normal portion in accordance with the aforesaid method of measurement, as in the case of the aforementioned $\overline{R}$. Namely, $X_T - \overline{X}$ is a measure of the periodic non-uniformity of the yarn, the value of which is preferably zero. However, in the present invention, it is defined as below 1.0 in consideration of precision of the measuring method.

It is preferable that the $\Delta S_5$ be a large numerical value and $\Delta S_{50}$ be a small numerical value. When $\Delta S_5$ is less than about 1.5, the yarn is poor in bulkiness whereas when $\Delta S_{50}$ is larger than about 3.0, when the yarn is woven into a fabric, defects by tight pick increase.

When the value of Y is smaller than about 1.3, it becomes impossible for the yarn to possess bulkiness and low contractibility preferable as a yarn for a knitted or woven fabric, and only a paper-like knitted or woven fabric is obtained.

In the present invention, the expression "being substantially non-interlaced" means that the cohering force of adjoining monofilaments is on the same level as that of an ordinary yarn having an ordinary twist of about 20 T/m, and such substantially non-interlaced multifilament yarn is distinguishable from an interlaced multifilament yarn by the coherency factor in the hook-drop test defined in the specification of U.S. Pat. No. 2,985,995. Namely, a yarn having a coherency factor of 2.5 or more is regarded as an interlaced yarn. The coherency factor of the aforementioned ordinary yarn is considerably less than 2.5, and the coherency factor value of a bulky processed yarn of the present invention is on the same level as that.

Using a process for producing-potentially bulky-polyester yarns (75 denier/36 filament) that are different in the aforesaid characteristic values as wefts, plain fabrics are woven. The results of evaluation of the qualities of such fabrics are summarized per each characteristic value in the following Tables 1–4. In each table, the mark O means a satisfactory product. The mark Δ means the product has faults to some extent. The mark X means the product has faults.

TABLE 1

| (Concerning characteristic value $R_{max}/\overline{R}$) | | | | |
|---|---|---|---|---|
| | $R_{max}/\overline{R}$ (g) | | | |
| Quality of fabric | 3.9 | 3.0 | 2.5 | 1.3 |
| Tight pick (splashed pattern) | X | Δ | 0 | 0 |
| Uneven dyeing | X | X | 0 | 0 |

TABLE 2

| (Concerning characteristic values of $\Delta S_5$ and $\Delta S_{50}$) | | | | | |
|---|---|---|---|---|---|
| | $\Delta S_5$ (%) | | | | |
| Quality and characteristics | 1.0 | 1.5 | 3.3 | 4.6 | 5.5 |
| | $\Delta S_{50}$ (%) | | | | |
| of fabric | 0.5 | 1.0 | 2.2 | 3.0 | 3.5 |
| Tight pick (splashed pattern) | 0 | 0 | 0 | 0 | X |
| Feel of bulk | X | Δ | 0 | 0 | 0 |

TABLE 3

| (Concerning characteristic value Y) | | | | | | |
|---|---|---|---|---|---|---|
| Characteristics | Y (cc/g %) | | | | | |
| of fabric | 0.7 | 1.0 | 1.3 | 2.1 | 3.2 | 3.9 |
| Feel of bulk | X | Δ | 0 | 0 | 0 | 0 |

TABLE 4

| (Concerning characteristic value of $X_T - \overline{X}$) | | | | | |
|---|---|---|---|---|---|
| | $X_T - \overline{X}$ (g) | | | | |
| Quality of fabric | (≈0) | 2 | 6 | 10 | 15 |
| Streakiness of pirn barre | 0 | Δ | Δ | Δ | X |

As mentioned above, a process for producing a potentially bulky yarn of the present invention results in is a non-interlaced multifilament yarn of the polyester series and the like satisfying simultaneously the aforesaid characteristic value of (A)-(D). Therefore, said potentially bulky processed yarn has more uniformity than a conventional potentially bulky yarn such as irregularly heat-treated yarn, having simultaneously sufficient bulkiness and low contractibility, and is an excellent yarn for making a knitted or woven fabric.

bulky yarn of the present invention comprises running a multifilament yarn of a thermoplastic synthetic fiber in contact with a heated body, characterized by supplying a substantially non-twisted multifilament yarn under a tension of about 10–120 mg/d to said heated body so as to bring about filaments contacting said heated body at an imaginary point of contact and filaments not contacting said heated body at said imaginary point of contact, at the same time, running said yarn in contact with said heated body within such a short period of time that the heat of said heated body is not conducted uniformly to said yarn, and thereafter winding said multifilament yarn. And there is another process which comprises, in the aforesaid process, prior to the winding step which is a final step, running said multifilament yarn in contact with another heated body under conditions of substantially not elongating the multifilament yarn to eliminate produced loops, and then winding said multifilament yarn.

The thermoplastic synthetic fibers used in the present invention are of the polyamide, polyester, polyolefin and polyvinyl series. And the thermoplastic synthetic fibers of the polyester series include, for example, polyethylene terephthalate, polyethylene oxybenzoate and a copolymer containing at least about 70% of these repeating units, a polymer composed mainly of these repeating units and a third component. The term "substantially non-twisted multi-filament yarn" referred to in the present invention means a yarn immediately after drawing an ordinary undrawn yarn and/or pre-oriented yarn irrespective of draw ratio, or a yarn wound around a package without being twisted after being drawn (for example, a drum wound yarn).

Next, the present invention will be explained by reference to a specific embodiment shown in the accompanying drawings.

Figure 6:
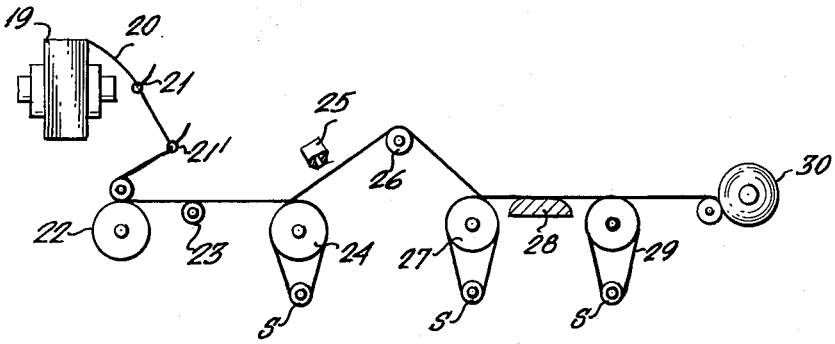
FIG. 6 is a fragmentary side elevation illustrating one embodiment of the present invention.

FIG. 6 is a fragmentary side elevation showing production of a yarn, in which yarn 20 is pulled out from an undrawn yarn package 19 and ordinarily drawn between a feed roller 22 and a roller 24 via guides 21 and 21'. It is preferable that the feed roller be one which nips the yarn by contact with a rubber surface, and a draw pin 23 is provided in between these two rollers. Next, the yarn passes through a hot pin 26 between roller 24 and roller 27. The roller 24 has a different peripheral speed from the roller 27. The yarn passes through the hot pin 26 under low tension (10–120 mg/d) less than the heat contraction stress of the yarn by the hot pin 26 within such a short period of time that the heat of the hot pin 26 may not be conducted uniformly to the running yarn. At this time, the yarn is supplied to the hot pin 26 while positively imparting vibration to the yarn by a vibration imparting device 25. The yarn coming out from the roller 27 is caused to contact a hot plate 28 to be heated between roller 27 and roller 29 having the same speed as the roller 27 and is thereafter wound on a winder 30. Each of the rollers 24, 27 and 29 has a separate roller S.

The yarn coming out from the roller 27 may be immediately wound around the winder without being heated by the hot plate 28.

As such, when a yarn is continuously heat-treated subsequent to drawing, such difference in strain of the original package as seen in a method of heat-treating a yarn pulled out from a drawn yarn package essentiallly does not exist ($X_T - X \approx 0$). What is illustrated in FIG. 3 is obtained by heat-treating a yarn pulled out from a drawn yarn package of pirn winding and irrespective of the shape of the package winding the yarn after said heat-treatment (t' shows that it is a tapered part of a pirn winding after said heat-treatment), there are differences in career (t and p) on the original package.

Figure 7:
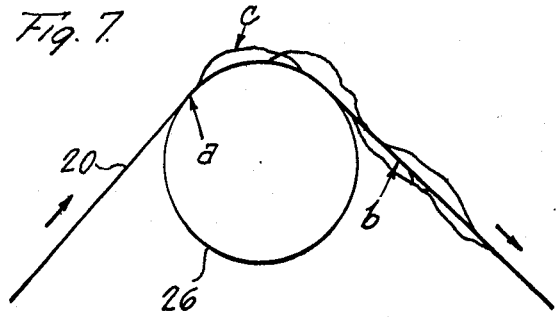
FIGS. 7 and 8 are side elevations showing behavior of a yarn on a hot pin.
Figure 8:
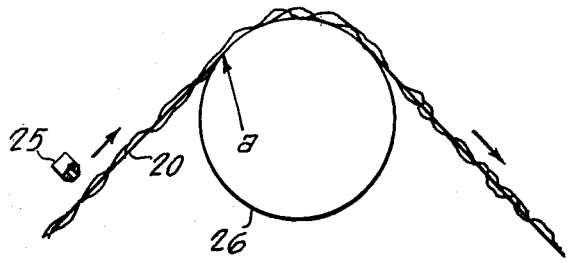

FIG. 7 and FIG. 8 are side elevations showing the behavior of a yarn on a hot pin.

The point where the yarn 20 passing the defined yarn passage naturally contacts the surface of the hot pin 26 is defined as an imaginary point of contact a.

In general, when a multifilament yarn is supplied to a hot pin, as shown in FIG. 7, the yarn contacts the surface of the heated body at the imaginary point of contact a. In the vicinity of this point a, in accordance with the amount of heat received from the heated body, a heat-treated filament b passes along the surface of the heated body, while a non-heat-treated filament c passes by without contacting the heated body. And when viewed in a direction of the length of one monofilament, heat-treated portions and non-heate-treated portions develop entirely at random since they are influenced by "twist" possessed by the yarn, tension of the supplied yarn and amount of a spin finish applied for spinning.

Especially, when the yarn supplied to the heated body is substantially non-twisted, the pitch of this heat-treated portion and non-heat-treated portion per each monofilament becomes long, and only a yarn having substantial unevenness and poor uniformity (when shown by the characteristic value $R_{max}/\overline{R}$, it reaches 3–4.5 sometimes) is obtained.

According to the process of the present invention, for example, because a yarn is supplied to the hot pin 26 while vibration is imparted to the yarn, as shown in FIG. 8, each monofilament does not necessarily contact the hot pin at the imaginary point of contact a, but contacts the hot pin ahead of or beyond the point of contact a. Because of that, the heat-treating pitch is fractionized, roughy the same heat-treating is effected for each monofilament; and the random property of heat-treatment by the heated body is controlled. It is thereby possible to produce a yarn having excellent uniformity.

Figure 9A:
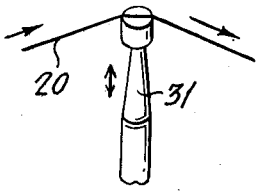
FIG. 9 are side elevations, as examples, illustrating vibration-imparting devices used in the present invention.
Figure 9B:
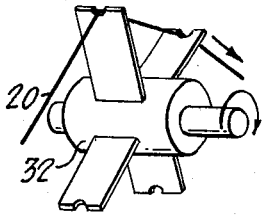
Figure 9C:
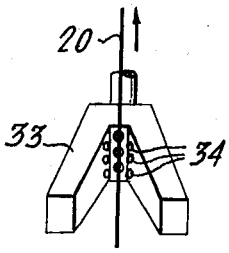

As vibration imparting devices, there are, for example, an element which contacts the yarn with an electrical vibrator 31 (FIG. 9 A), or applies a rotating impeller 32 to the yarn 20 (FIG. 9 B), or uses a fluid jet device 33 and sprays a fluid jetted from orifices 34 of said device to the yarn 20 (FIG. 9 C). Other suitable devices may be used.

When the tension of a yarn upon imparting vibration is too high, vibration is unlikely to be imparted, and when it is too low, yarn breakage tends to occur. Therefore, the tension is controlled to the range of 10–120 mg/d at a portion where the yarn enters the heated body. In order to impart vibration effectively, two or more vibration imparting devices may be used.

The temperature of the hot pin 26 is adapted to be within the range from the secondary transition point of the yarn to the melting point of the yarn. However, preferably it is within the range from the secondary transition point of the yarn to a temperature 10° C. lower than the melting point of the yarn. When said temperature is too close to the melting point of the yarn, there is a possibility that the yarn may melt and break, and when said temperature is lower than the secondary transiton point of the yarn on the contrary, the desired yarn cannot be obtained.

The temperature of the heated body such as the hot plate 28 may be a temperature suitable for eliminating and making latent the loops produced in the preceding stage. For example, a range from the secondary transition point to a temperature 25° C. lower than the temperature of the heated body in the preceding step is desirable. Unless a temperature lower than the heating temperature in the preceding step is adopted, the desired bulkiness cannot be obtained.

For eliminating loops, the step of winding the yarn under a tension sufficient for eliminating loops is adopted, as shown in Comparative Example 5. Only a yarn small in bulkiness and large in shrinkage is obtained.

A yarn obtained according to the process of the present invention is a potentially bulky yarn whose appearance is the same as an ordinary yarn or a yarn having a so-called slack loop, being uniform as a yarn, having sufficient bulkiness and low contractibility.

EXAMPLE I

By an apparatus illustrated in FIG. 6, a 262 denier/36 filaments polyethylene terephthalate (having a triangular section) undrawn yarn was drawn 3.5 times at a speed of 360 m/min to make it 75 denier, followed by overfeeding of the drawn yarn by 10% between the rollers 24 and 27. The vibration imparting device 25 by jetting of air had 9 orifices each having a diameter of 0.5 mm $\phi$ disposed at regular intervals of 3 mm as shown in FIG. 9 C, and while vibrating the yarn by jetting of air under pneumatic pressure of 0.8 kg/cm$^2$ to the yarn passage of the yarn, the yarn was supplied to a hot pin having a diameter of 35 mm $\phi$ at a temperature of 215° C. to carry out a heat-treatment. At this time, the supply tension to the hot pin was about 2.5 g (33 mg/d) and the contact length was about 5.1 cm. Subsequently, the yarn was brought into contact with the 25 cm (long) plain hot plate 28 heated at 135° C. between the roller 27 and the roller 29 having the same speed as the roller 27 to thereby eliminate loops, and thereafter would by a winder (ring twister) 30 (sample 1).

A yarn having loops was obtained without using the hot plate 28 under otherwise the same conditions as in the case of sample 1 (sample 2).

For purposes of comparison, a yarn obtained by a heat-treatment without being subjected to vibration under otherwise the same conditions as in the case of sample 1 (sample 3), and an ordinary yarn (sample 4) were prepared. The yarn characteristics of these samples 1–4 were as shown in Table 5.

TABLE 5

| | C* | | | | | | |
|---|---|---|---|---|---|---|---|
| S** | M | SH | Y | $R_{max}/\overline{R}$ | $\Delta S_5$ | $\Delta S_{50}$ | $X_T - \overline{X}$ |
| 1 | 20.8 | 12.2 | 1.70 | 1.15 | 4.1 | 1.7 | 0 |
| 2 | 22.8 | 13.5 | 1.69 | 1.35 | 6.2 | 1.9 | 0 |
| 3 | 20.1 | 13.0 | 1.55 | 3.84 | 5.0 | 2.8 | 0 |
| 4 | 10.2 | 19.0 | 0.53 | 1.10 | 0 | 0 | — |

NOTE
C*: Characteristics
S**:Sample

The yarns produced according to the process of the present invention (samples 1 and 2) had uniformity as a yarn, and the $R_{max}/\overline{R}$ values were roughly close to that of an ordinary yarn (sample 4). Moreover, they were low-contractible yarns having excellent bulkiness. In sample 3, the $R_{max}/\overline{R}$ was 3.8, which was large and uniformity was not achieved.

Further, using these samples 1–4, plain fabrics were woven, the resulting fabrics were subjected to ordinary scouring and thereafter to a dry heat-treatment at 180° C. for 30 seconds and then dyed and finished. The characteristics of each of these four fabrics were as follows.

Fabric Woven from Sample 1

The fabric had thickness, a very short splash pattern, mild luster and a non-slick hand, and was excellent in depth and clearness of color.

Fabric Woven From Sample 2

The thickness of the fabric was maximum and a very short splash pattern was weaker and more infrequent than that of sample 1. The luster and hand of the fabric was the same as in sample 1. The depth and clearness of color was somewhat inferior to those of sample 1. However, the difference was almost undistinguishable.

Fabric Woven from Sample 3

It had fabric thickness. However, it was a fabric like sakker in which tight and slack portions that were longer and stronger than those in samples 1 and 2 existed in admixture. Unevenness remained on the surface and it was unseemly. The hand was firm. The depth and clearness of color were the same as those of sample 1.

Fabric Woven from Sample 4

The thickness of the fabric was minimum. The fabric had no splash pattern. The luster was a metallic luster, having considerably strong waxy feeling. The depth and clearness of color were most inferior.

EXAMPLE 2

By an apparatus as illustrated in FIG. 6, a 239 denier/24 filaments polycapramide undrawn yarn was drawn 3.4 times at a speed of 400 m/min to make it 75 denier. The resultant drawn yarn was overfed by 7% between the rollers 24 and 27, supplied to a hot pin having a diameter of 60 mm $\phi$ heated at 200° C. while imparting vibration the same as in Example 1 to the yarn to carry out heat-treatment, and thereafter wound by a winder (ring twister) 30 (sample 5). At this time, the supply tension to the hot pin was about 2 g (29 mg/d) and the length of contact with the hot pin of the yarn was about 6.3 mm. The yarn characteristics of sample 5 and an ordinary yarn (sample 6) were as shown in Table 6.

TABLE 6

| | C* | | | | | | |
|---|---|---|---|---|---|---|---|
| S** | M | SH | Y | $R_{max}/\overline{R}$ | $\Delta S_5$ | $\Delta S_{50}$ | $X_T - \overline{X}$ |
| 5 | 8.1 | 6.0 | 1.35 | 1.25 | 2.1 | 1.1 | ≈0 |
| 6 | 4.9 | 10.1 | 0.49 | 1.19 | 0 | 0 | 4.5 |

NOTE
C*:Characteristics
S**:Sample
Measuring of M was carried out using 5 skeins.

Using samples 5 and 6, plain fabrics were woven that were subjected to ordinary scouring. Thereafter, they were heat-set at 170° C. for 30 seconds and then dyed and finished. The characteristics of each of these two fabrics were as follows:

Fabric Woven from Sample 5

The fabric has some thickness and a slight weak splash pattern. The luster was mild and little waxy in feeling. The depth and clearness of color were excellent.

Fabric Woven from Sample 6

The fabric was poor in thickness, having no splash pattern. The luster was a cold metallic luster and the fabric had a strong waxy feeling. The depth and clearness of color were excellent.

EXAMPLE 3

Experiment (1)

Under the same conditions as in the method of producing sample 1 in Example 1 except for varying the overfeed ratio between the rollers 24 and 27 and the yarn supply tension to the hot pin 26, a series of yarns were obtained.

Experiment (2)

By an apparatus as illustrated in FIG. 6, a 105 denier/12 filament polyethylene terephthalate (triangular section) undrawn yarn was drawn 3.5 times at a speed of 436 m/min to make it 30 denier. Next, between the rollers 24 and 27, using the same vibration imparting device as in Example 1, while the yarn was vibrated under a pneumatic pressure of 0.6 kg/cm$^2$, the overfeed ration of the yarn was varied and the yarn supply tension to the hot pin 26 (having a diameter of 35 mm $\phi$, heated at 215° C., the length of contact of the yarn therewith was about 5.1 cm) was also varied, each one of the drawn yarns was brought into contact with the 25 cm (long) plain hot plate 28 heated at 130° C. between the rollers 27 and 29 rotating at the same speed to eliminate loops and thereafter wound by the winder 30 (ring twister) to obtain a series of yarns.

When the characteristic values and operational stability of these yarns were shown, they became as shown in Table 7.

In Table 7, in the column of operational stability, X means frequent occurrence of yarn breakage and being impossible to proceed, Δ means occurrence of yarn breakage to some extent and being unstable, while 0 means no yarn breakage and being capable of stable processing.

TABLE 7

| Sample | Supply tension to the hot pin (mg/d) | M | SH | Y | Operational stability |
|---|---|---|---|---|---|
| | 5.3 | — | — | — | X |
| Experiment | 9.3 | 25.2 | 9.9 | 2.54 | Δ |
| (1) | 26.7 | 22.5 | 11.4 | 1.97 | 0 |
| | 41.3 | 20.2 | 12.1 | 1.67 | 0 |
| Experiment | 73.5 | 22.6 | 12.5 | 1.81 | 0 |
| (2) | 116.7 | 18.5 | 13.0 | 1.42 | 0 |
| | 155.0 | 16.8 | 13.8 | 1.22 | 0 |

From Table 7, it is seen that when the yarn supply tension to the hot pin was decreased, operational stability could not be satisfied, and when said tension was increased, on the contrary, Y lowered.

EXAMPLE 4

Under the same conditions as in the case of sample 1 in Example 1 except for varying the temperature of the hot plate 28 (having a length of 25 cm), a series of yarns was obtained. The characteristic values of these yarns were as shown in Table 8.

TABLE 8

| Hot pin temperature °C. (A) | Plain hot plate temperature °C. (B) | Temperature difference (A) -(B) | M | SH | Y |
|---|---|---|---|---|---|
| | 140 | 75 | 21.0 | 12.0 | 1.75 |
| | 150 | 65 | 20.2 | 11.6 | 1.74 |
| 215 | 160 | 55 | 19.0 | 11.1 | 1.71 |
| | 170 | 45 | 17.5 | 11.0 | 1.59 |
| | 180 | 35 | 15.5 | 10.8 | 1.43 |
| | 190 | 25 | 13.3 | 10.5 | 1.27 |
| | 200 | 15 | 12.0 | 9.6 | 1.25 |

As shown in Table 8, when the difference of temperature was 15° C., M became 12.0 and the yarn could not realistically be called a bulky yarn. The difference of temperature is preferably not less than 25° C.

Comparative Example 5

A yarn processed under the same conditions as in the case of sample 1 in Example 1 and passing through the hot pin was elongated to the degree necessary for eliminating slack loops (9.3% at room temperature) without using the plain hot plate 28 and thereafter wound by the winder 30 (ring twister) (sample 7). The yarn characteristics of sample 7 were as shown in Table 9.

TABLE 9

| M | SH | Y | $R_{max}/\overline{R}$ | $\Delta S_5$ | $\Delta S_{50}$ | $X_T - \overline{X}$ |
|---|---|---|---|---|---|---|
| 12.9 | 16.5 | 0.78 | 1.60 | 3.7 | 2.0 | ≈0 |

The elongation of 9.3% was roughly the minimum elongation for eliminating the loop. As compared with samples 1 and 2 of Example 1, sample 7 was small in M and large in SH, namely, Y was extremely small. A plain fabric obtained by weaving sample 7 was a paper-like woven fabric having no thickness and only a woven fabric dyed in a light color conspicuous in a splashed pattern as tight pick was obtained.

COMPARATIVE EXAMPLE 6

While a 75 denier/36 filament polyethylene terephthalate drawn yarn (warp wind) was overfed by 10% between the rollers 24 and 27 in an apparatus illustrated in FIG. 6 (omitting a drawing part), it was supplied to a hot pin having a diameter of 35 mm $\phi$ heated at 215° C. at a speed of 360 m/min. The yarn supply tension to the hot pin was about 1.9 g (25 mg/d) and a length of contact of the yarn with the hot pin was 5.1 cm.

Next, the yarn was brought into contact with the 25 cm (long) plain hot plate 28 heated at 135° C. between the rollers 27 and 29 of the same speed and thereafter wound by the winder 30 (ring twister) (sample 8).

Under the same conditions as in the case of sample 8, a vibration imparting device the same as in Example 1 was applied to obtain a processed yarn (sample 9). The yarn characteristics of these yarns were as shown in Table 10.

TABLE 10

| Sample | M | SH | Y | $R_{max}/\overline{R}$ | $\Delta S_5$ | $\Delta S_{50}$ | $X_T - \overline{X}$ |
|---|---|---|---|---|---|---|---|
| 8 | 22.5 | 11.5 | 1.96 | 1.96 | 4.5 | 2.0 | 7 |
| 9 | 21.4 | 12.1 | 1.77 | 1.56 | 4.8 | 2.0 | 6 |

There were $X_T - \overline{X}$ values in samples 8 and 9. As a result of using each of the yarns of these samples as a weft yarn of a plain fabric the same as in Example 1, a periodic tight pick having a pitch of about 2.7 cm was recognized on the fabrics and weak puckering occurred.

COMPARATIVE EXAMPLE 7

A 75 denier/36 filament polyethylene terephthalate interlaced multifilament yarn (coherency factor indicating monofilament adhesion 31, drum wind yarn) was processed under the same conditions as in sample 8 of Comparative Example 6 to obtain sample 10. The characteristic values of sample 10 were as shown in Table 11.

TABLE 11

| M | SH | Y | $R_{max}/\overline{R}$ | $\Delta S_5$ | $\Delta S_{50}$ | $X_T - \overline{X}$ |
|---|---|---|---|---|---|---|
| 14.5 | 11.2 | 1.27 | 1.30 | 3.0 | 1.8 | 0 |

It is seen that the degree of bulkiness was low. As a result of using sample 10 as a weft yarn of a plain fabric the same as in Example 1, a woven fabric having uneven feeling remaining on the surface thereof, unseemly and poor in thickness of fabric, was obtained.

The following is claimed:

1. In a process for producing a potentially bulky yarn comprising contacting said yarn with a heated body, the improvement comprising: providing a substantially non-twisted multi-filament yarn, overfeeding said yarn to a first heated body by means of a pair of overfeed advancing rolls, heating said first heated body to a temperature within the range from the secondary transition point of said yarn to a temperature about 10° C. lower than the melting point of yarn, causing contact of said yarn with said heated body while concurrently vibrating said yarn and subjecting it to tension in the range of about 10–120 mg/d, said tension being imparted by means separate from said overfeed advancing rolls, running said yarn over said heated body at such speed and within such a short period of time that at an imaginary point of contact certain filaments of said yarn are caused to contact said heated boty while the remaining filaments of said yarn are not contacted by said heated body at said imaginery point of contact, and thereafter winding said multifilament yarn.

2. Process as defined in claim 1 comprising overfeeding said yarn by about 7–10% between said pair of advancing rolls.

3. Process as defined in claims 1 or 2 wherein said multifilament yarn comprises polyester filaments.

4. Process as defined in claims 1 or 2 wherein said multifilament yarn comprises polyamide filaments.

5. Process as defined in claims 1 or 2 further comprising drawing said yarn prior to said overfeeding.

6. Process as defined in claim 1 further comprising, prior to said winding, running said multifilament yarn in contact with a second heated body while providing tension on the yarn sufficient to not substantially elongate said yarn thereby eliminating produced loops.

7. Process as defined in claim 6 further comprising drawing said yarn prior to said overfeeding.

8. Process as defined in claim 6 wherein said multifilament yarn comprises polyester filaments.

9. Process as defined in claim 6 wherein said multifilament yarn comprises polyamide filaments.

10. Process as defined in claim 6 comprising heating said second heated body to a temperature within the range from the secondard transition point of said yarn to a temperature about 24° C. lower than the temperature of said first heated body.

11. A substantially non-interlaced thermoplastic multifilament yarn produced by the process comprising, providing a substantially non-twisted multifilament yarn, overfeeding said yarn to a first heated body by means of a pair of overfeed advancing rolls, heating said first heated body to a temperature within the range from the secondary transition point of said yarn to a temperature about 10° C. lower than the melting point of said yarn, causing contact of said yarn with said heated body while concurrently vibrating said yarn and subjecting it to tension in the range of about 10–120 mg/d, said tension being imparted by means separate from said overfeed advancing rolls, running said yarn over said heated body at such speed and within such a short period of time that at an imaginery point of contact certain filaments of said yarn are caused to contact said heated body while the remaining filaments of said yarn are not contacted by said heated body at said imaginary point of contact, and thereafter winding said multifilament yarn.

12. A substantially non-interlaced thermoplastic multifilament yarn produced by the process comprising, providing a substantially non-twisted multifilament yarn, overfeeding said yarn to a first heated body by means of a pair of overfeed advancing rolls, heating said first heated body to a temperature within the range from the secondary transition point of said yarn to a temperature about 10° C. lower than the melting point of said yarn, causing contact of said yarn with said heated body while concurrently vibrating said yarn and subjecting it to tension in the range of about 10–120 mg/d, said tension being imparted by means separate from said overfeed advancing rolls, running said yarn over said first heated body at such speed and within such a short period of time that at an imaginary point of contact certain filaments of said yarn are caused to contact said first heated body while the remaining filaments of said yarn are not contacted by said first heated body at said imaginary point of contact, running said multifilament yarn in contact with a second heated body while providing tension on said yarn sufficient to not substantially elongate said yarn, thereby eliminating produced loops, and thereafter winding said yarn,

13. A substantially non-interlaced thermoplastic multi-filament yarn as defined in claim 12 produced by the further step of heating said second heated body to a temperature within the range from the secondary transition point of said yarn to a temperature about 25° C. lower than the temperature of said first heated body.

* * * * *

UNITED STATES PATENT AND TRADEMARK OFFICE

CERTIFICATE OF CORRECTION

PATENT NO. : 4,263,368

DATED : 4/21/81

INVENTOR(S) : Yukio Otaki et al

It is certified that error appears in the above—identified patent and that said Letters Patent is hereby corrected as shown below:

Column 1, line 11 after "a" insert --process for producing a--.

Column 1, line 63, delete "another" and substitute --other--.

Column 2, line 11 delete "potentially".

Column 2, line 34, delete "potentially".

Column 3, line 54, delete "48,000 : 4,800" and substitute --48,000 ÷ 4,800--.

Column 3, line 55, delete "48,000:" and substitute --48,000÷--.

Column 4, line 21, delete "measuring" and substitute --measurement--.

Column 4, line 25, delete "the".

Column 5, line 43, delete "is".

Column 5, line 52, before "bulky" insert

--A preferable process for producing a potentially--.

UNITED STATES PATENT AND TRADEMARK OFFICE

CERTIFICATE OF CORRECTION

PATENT NO. : 4,263,368

DATED : 4/21/81

INVENTOR(S) : Yukio Otaki et al

It is certified that error appears in the above—identified patent and that said Letters Patent is hereby corrected as shown below:

Column 7, line 2, delete "heate" and substitute --heat--.

Column 8, line 21, delete "would" and substitute --wound--.

Column 12, line 23, delete "boty" and substitute --body--.

Signed and Sealed this

*Fourteenth* Day of *September 1982*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,263,368

DATED : April 21, 1981

INVENTOR(S) : Yukio Otaki et al

It is certified that error appears in the above-identified patent and that said Letters Patent is hereby corrected as shown below:

Page 1, as line following line "[22] Filed: Jan 5, 1975", insert:

--[30] Foreign Application Priority Data

July 15, 1974 [JP] Japan.....80158/74--.

Signed and Sealed this

*Eleventh* Day of *June 1985*

[SEAL]

*Attest:*

DONALD J. QUIGG

*Attesting Officer* *Acting Commissioner of Patents and Trademarks*